United States Patent [19]

Marco

[11] 4,086,055

[45] Apr. 25, 1978

[54] SURFACE MODIFIED CONTINUOUS FILAMENT YARN AND METHOD OF PRODUCING SAME

[75] Inventor: Francis William Marco, Pauline, S.C.

[73] Assignee: Milliken Research Corporation, Spartanburg, S.C.

[21] Appl. No.: 729,177

[22] Filed: Oct. 4, 1976

[51] Int. Cl.[2] ..... D06M 3/16; D06M 5/00; D06M 9/00

[52] U.S. Cl. ..... 8/130.1; 8/114.6; 8/132; 8/DIG. 3; 8/DIG. 4; 8/DIG. 21

[58] Field of Search ..... 8/130.1, 132, DIG. 3, 8/DIG. 4, DIG. 21, 114.6

[56] References Cited

U.S. PATENT DOCUMENTS

| | | | |
|---|---|---|---|
| 2,861,865 | 11/1958 | Siggel | 18/54 |
| 2,989,797 | 6/1961 | Nusslein | 28/75 |
| 3,002,804 | 10/1961 | Kilian | 18/54 |
| 3,528,763 | 9/1970 | Runton | 8/125 |
| 3,663,677 | 5/1972 | Keuchel | 264/210 F |
| 3,679,355 | 7/1972 | Yamaguchi et al. | 8/130.1 |
| 3,752,648 | 8/1973 | Shichijo et al. | 8/130.1 |

*Primary Examiner*—John Kight, III
*Attorney, Agent, or Firm*—H. William Petry; Glen M. Burdick

[57] ABSTRACT

A surface modified continuous filament yarn and method for producing same is provided wherein a continuous filament twisted yarn is stretched and, while in its stretched or elongated state, contacted with an effective amount of a swelling agent for a period of time effectively to substantially rupture fibers on the surface of the elongated yarn without effecting interior fibers of the yarn, thereafter quenching the swelling agent and recovering a modified continuous filament yarn.

13 Claims, 1 Drawing Figure

SURFACE MODIFIED CONTINUOUS FILAMENT YARN AND METHOD OF PRODUCING SAME

Figure 1:
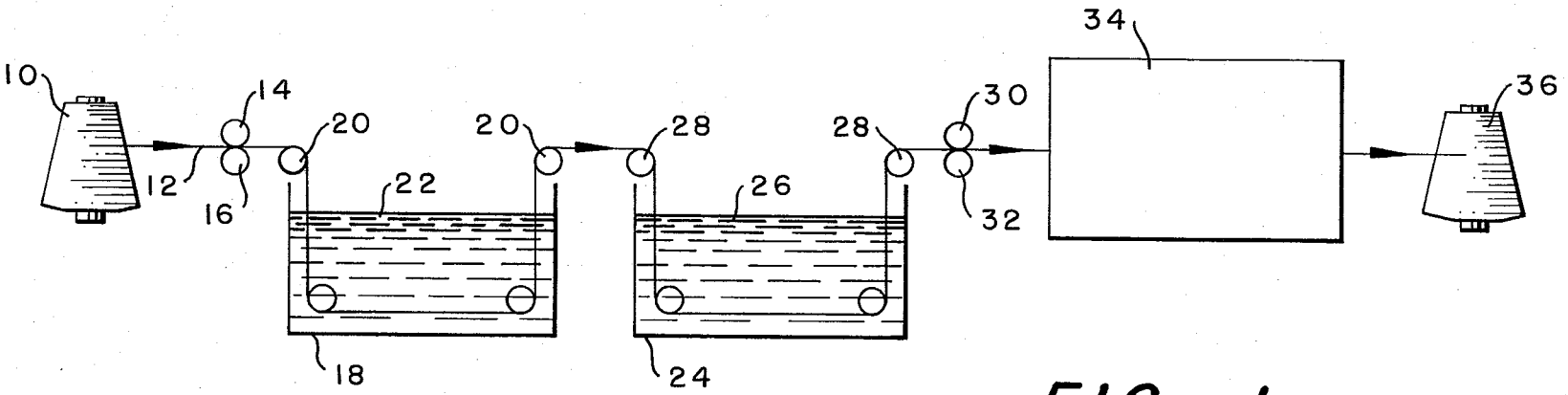

This invention relates to continuous filament twisted yarns. In one aspect, it relates to continuous filament twisted yarns having a surface appearance resembling a spun yarn. In another aspect it relates to a method for modifying the surface of continuous filament twisted yarn.

Yarns produced from synthetic fibers have been employed as industrial cords for reinforcement in rubber products such as conveyor belts, diaphragms, tires, and the like. Because of their improved adhesion to rubber, spun yarns have heretofore been employed as the cord component. When employing industrial cords of synthetic fibers, the spun yarns have conventionally been made by first extruding continuous filament fibers and thereafter chopping the fibers into small segments. The small segments of fiber are then carded, drawn, and spun into yarns. Because of the method of preparation of such spun yarns from synthetic fibers the resulting products have not possessed the strength of continuous filament yarns. However, because of adhesion problems between continuous filament yarns and rubber, rubber products produced containing such yarns often fail due to separation and the like. Thus, it would be desirable if a continuous filament yarn could be developed which would readily adhere to rubber while maintaining desired physical properties, such as elongation, strength, elastic recovery and the like.

Therefore, it is an object of this invention to provide a continuous filament yarn having improved adherence to rubber. Another object is to provide an improved continuous filament yarn of synthetic fibers which readily adheres to rubber without loss of elongation, strength, and elastic recovery. Yet another object of the invention is to provide an improved method for producing a synthetic continuous filament yarn having a spun yarn surface appearance. These and other objects, advantages and features of the invention will be apparent to those skilled in the art from a reading of the following detailed description.

According to the present invention, I have now discovered an improved method for modifying the surface of a synthetic continuous filament twisted yarn so as to render the yarn spun like in appearance. Broadly, the invention comprises stretching a twisted yarn to provide an elongated yarn, contacting the elongated yarn with an effective amount of a swelling agent for a period of time effective to substantially rupture fibers on the surface of the elongated yarn without affecting interior fibers of the yarn, quenching the swelling agent and thereafter recovering the modified continuous filament synthetic yarn.

Drawings accompanying and are made a part of this disclosure. In the drawings

FIG. 1 is a schematic representation of suitable apparatus which can be employed to produce the modified continuous filament yarn in accordance with the present invention.

Referring to FIG. 1 of the drawing, the general process for modifying the surface of a continuous filament twisted yarn is set forth. It is to be understood that the apparatus depicted in FIG. 1 is merely illustrative of apparatus which can be employed to practice the method of the present invention and such is not to be construed as limiting as to the method of such invention. Reference numeral 10 represents a yarn supply package of continuous filament twisted yarn 12, such as nylon. Yarn 12 passes into the nip of feed roll 14 and 16 from whence it is supplied into treating vessel 18. Treating vessel 18 is provided with a plurality of idler rolls 20 to maintain yarn 12 within swelling agent 22 of treating vessel 18. After passing through treating vessel 18 the yarn 12 is passed into vessel 24 which contains a quenching solution 26. Idler rolls 28 are provided within vessel 24 to assure that yarn 12 is passed through the quenching solution. Yarn 12 then passes into the nip of feed rolls 30 and 32. Rolls 30 and 32 are driven at a speed slightly faster than nip rolls 14 and 16 in order to maintain a pre-determined tension in the yarn between the two pairs of rolls thus maintaining yarn 12 in a stretched or elongated state during contact of the yarn with the swelling agent and the quenching solution. The yarn from nip rolls 30 and 32 is passed through a suitable dryer 34 and then taken up on a bobbin 36. It should be noted that if one is to produce the desired product of the present invention, the yarn must be a twisted yarn and maintained under tension during contact with the swelling agent and the quenching solution.

The continuous filament twisted yarn which can be employed in the process of the present invention to produce the modified continuous filament yarns having surface characteristics similar to spun yarns can be either single, multi-filament, or plied multi-filament twisted yarns. Further, such yarns can be any suitable continuous filament twisted yarn produced from synthetic fibers such as acrylic, polyester, rayon, acetate, nylon, and the like. Especially desirable results can be obtained when the continuous filament twisted yarns are produced from polyester or nylon fibers. The term "twisted" yarn as used herein is to be understood to mean any "S" configuration or "Z" configuration twisted yarn such as is well known in the art.

Once the desired continuous filament twisted yarn has been chosen, the yarn is stretched by any suitable means such as the nip rolls depicted in FIG. 1 to provide an elongated yarn. The amount of stretching or elongation of the yarn can vary widely within the elastic limits of the yarn. However, especially desirable results have been obtained when the stretching or elongation of the yarn is such that the yarn is elongated from about 5 to about 30 percent of the yarn in its relaxed state. The elongated or stretched yarn is then contacted with an effective amount of a swelling agent for a period of time effective to substantially rupture fibers on the surface of the elongated yarn without effecting interior fibers of the yarn. It has been found that by contacting the continuous filament twisted yarn in its stretched or elongated state that the swelling agent and its effect can be substantially limited to the surface fibers of the elongated or stretched yarn. This phenomenon is true even though the particular swelling agent employed would have a serious deleterious effect upon a continuous filament yarn if contacted with the continuous filament yarn in its relaxed state. Any suitable swelling agent can be employed to produce the modified continuous filament yarns of the present invention. The particular choice of swelling agent will depend somewhat upon the type of continuous filament twisted yarn employed. For example, when employing a nylon continuous filament twisted yarn suitable swelling agents are glacial acetic acid or aqueous solutions containing from about 5 to about 50 weight percent of a zinc chloride or phenol swelling agent. When the continuous filament twisted yarn is a polyester yarn, desirable results can be obtained when the swelling agent is methylene chloride or an aqueous solution containing from about 5 to about 100 weight percent phenol. Numerous other swelling agents can be employed for modifying nylon and polyester continuous twisted yarns, as well as other synthetic derived continuous filament twisted yarns according to the process of the invention. The time in which the elongated or stretched yarn is contacted with the swelling agent can vary widely. However, since it is preferable that the process be operated as a continuous process the contact time between the elongated or stretched yarn and the swelling agent will generally be from about 1 second to about 60 seconds. Such time period is generally effective to provide the desired rupture of the surface fibers of the filament yarn to produce the spun like appearance of the yarn, but will prevent unwanted attack of the interior fibers of the continuous filament yarn.

After the stretched or elongated yarn has been contacted with the swelling agent, the treated yarn is passed through a quenching solution so as to neutralize, deactivate, and remove any residual swelling agent from the yarn. Any suitable quenching solution can be employed and the particular choice of the quenching solution will be dependent to a large extent upon the nature of the swelling agent. However, from an economical standpoint, water is the preferred quenching solution. It should be further noted that the quenching of the swelling agent is conducted while the yarn is in its elongated or stretched state. By maintaining the yarn in its elongated or stretched state, substantially all of the swelling agent can be neutralized or removed from the yarn thus preventing entrapment of swelling agent within the fibers of the yarn where the tension on the yarn is removed.

Since the treated continuous filament yarn is in a wetted state after the contact with the swelling agent and the quenching solution, the modified continuous filament yarn is generally dried and then recovered on a suitable take-up member, such as a bobbin. Further, if desired, additional processing steps can be employed, such as dyeing and the like.

The modified continuous filament yarn produced according to the process described hereinbefore has the advantages as to physical properties, e.g., elongation, strength, elastic recovery and the like, of the continuous filament yarns but, due to such treatment, has a surface which resembles that of spun yarns. Further, the spun like surface of the continuous filament yarn possesses improved adhesion to rubbers and thus the product benefits from the desired properties of both a continuous filament yarn and a spun yarn.

In order to more fully illustrate the present invention, the following example is given. However, it is to be understood that the example is for illustrative purposes only and is not to be construed as unduly limiting the scope of the present invention.

EXAMPLE I

An "S" twist continuous multi-filament yarn of nylon 66 was placed under tension to provide a 20 percent elongation. The elongated multi-filament yarn was then contacted with glacial acetic acid to allow swelling and subsequent rupturing of the surface fibers of the yarn. The resulting product was then washed with water to remove any residual glacial acetic acid and thereafter the fiber was allowed to relax. The reaction between the swelling agent and the surface fibers of the continuous filament yarn resulted in a yarn having a fuzzy, spun-like appearance. Upon observation it was noted that the resulting product possessed an outward appearance similar to spun yarns while still maintaining a sufficient strength factor similar to a continuous filament yarn.

Although a preferred embodiment of the invention has been shown herein and described, changes and modifications can be made in the illustrative and described structure without departure from the basic principles of the method and product of the present invention. Changes and innovations of this type are therefore deemed to be circumscribed by the spirit and scope of the invention, except as the same may be necessarily excluded by the appended claims or reasonable equivalents thereof.

Having thus described the invention, I claim:

1. A method for modifying the surface of a continuous filament twisted yarn comprising stretching said yarn to provide an elongated yarn and simultaneously contacting said elongated yarn with an effective amount of a swelling agent for a period of time effective to substantially rupture fibers on the surface of said elongated yarn without affecting interior fibers of said yarn, quenching said swelling agent, and recovering a modified continuous filament yarn.

2. The product produced according to claim 1.

3. The method of claim 1 wherein the amount of elongation of said elongated yarn is from about 5 to about 30%.

4. The method of claim 3 wherein said continuous filament twisted yarn is a multi-filament twisted yarn.

5. The product produced according to claim 4.

6. The method of claim 4 wherein said multi-filament twisted yarn is a nylon yarn.

7. The product produced according to claim 6.

8. The method of claim 6 wherein said swelling agent is glacial acetic acid.

9. The method of claim 6 wherein said swelling agent is an aqueous solution containing from about 5 to 50 weight percent of a swelling agent selected from the group consisting of zinc chloride and phenol.

10. The method of claim 4 wherein said multi-filament twisted yarn is a polyester yarn.

11. The product produced according to claim 10.

12. The method of claim 10 wherein said swelling agent is methylene chloride.

13. The method of claim 10 wherein said swelling agent is an aqueous solution containing from about 5 to 100 weight percent phenol.

* * * * *